United States Patent [19]

Narasimhan et al.

[11] Patent Number: 4,721,538

[45] Date of Patent: Jan. 26, 1988

[54] PERMANENT MAGNET ALLOY

[75] Inventors: Kalathur S. V. L. Narasimhan, Monroeville; Bao-Min Ma, Pittsburgh, both of Pa.

[73] Assignee: Crucible Materials Corporation, Pittsburgh, Pa.

[21] Appl. No.: 876,664

[22] Filed: Jun. 20, 1986

Related U.S. Application Data

[62] Division of Ser. No. 629,384, Jul. 10, 1984, abandoned.

[51] Int. Cl.[4] ..... C22C 38/00

[52] U.S. Cl. ..... 148/302; 420/83; 420/121

[58] Field of Search ..... 148/105, 302; 420/83, 420/121

[56] References Cited

U.S. PATENT DOCUMENTS 4,597,938 7/1986 Matsuura et al. ..... 148/105

FOREIGN PATENT DOCUMENTS 0101552 2/1984 European Pat. Off. ..... 148/31.57
54-76419 5/1979 Japan ..... 148/31.57

OTHER PUBLICATIONS

Hadjipanayis, G. C. et al., "New Iron-Rare-Earth Based Permanent Magnet Materials", Appl. Phys. Lett., vol. 43, No. 8, Oct. 15, 1983.

*Kirk-Othmer Encyclopedia of Chemical Technology,* 3rd Ed., vol. 19, p. 833.

*Condensed Chemical Dictionary,* 8th Ed., 1971, p. 869.

The Condensed Chemical Dictionary, Eighth Edition, Revised by Gessner G. Hawley, p. 290.

Croat et al., "Proceeding of the 29th Annual Conference on Magnetism and Magnetic Materials," Journal of Applied Physics, vol. 55, No. 6, Part II, Nov. 8-11, 1983, pp. 2078-2082.

Sagawa et al., "Proceedings of the 29th Annual Conference on Magnetism and Magnetic Materials," Journal of Applied Physics, vol. 55, No. 6, Part II, Nov. 8-11, 1983, pp. 2083-2087.

*Primary Examiner*—Melvyn J. Andrews
*Assistant Examiner*—Deborah Yee
*Attorney, Agent, or Firm*—Finnegan, Henderson, Farabow, Garrett & Dunner

[57] ABSTRACT

A rare-earth element permanent magnet alloy characterized by good magnetic alignment and high energy product, said magnet consisting essentially of, in atomic percent, at least one rare earth element didymium, mischmetal, neodymium and thorium 12 to 20, boron 4 to 14 and balance iron.

1 Claim, No Drawings

PERMANENT MAGNET ALLOY

This application is a division of application Ser. No. 629,384, filed July 10, 1984, now abandoned.

It is known to provide rare-earth element containing permanent magnet alloys wherein a rare earth element, for element samarium, is alloyed with cobalt. Magnet alloys of this type produce permanent magnets having good magnetic alignment and high energy product, which properties provide for magnets that may be reduced in size without sacrifice in magnetic performance. Cobalt, however, is a scarce and expensive alloying addition. Therefore, its use in magnets of this type renders the magnet and the assembly with which it is used extremely expensive.

It is accordingly a primary object of the present invention to provide a rare-earth element containing alloy which does not contain cobalt but nevertheless is characterized by good magnetic alignment and high energy product.

This and other objects of the invention, as well as a more complete understanding thereof, may be obtained from the following description and specific examples:

Broadly in accordance with the invention it has been determined that if a rare earth element selected from the group consisting of didymium, mischmetal or neodymium and thorium in combination are alloyed with boron and iron within restricted limits magnets made from the alloys will exhibit good magnetic alignment and high energy product. The rare earth element is within the range of, in atomic percent, 12 to 20 and if a combination of neodymium and thorium are present neodymium is within the range of 8 to 15, thorium is within the range of 6 to 10 with the total neodymium and thorium being 12 to 20. Boron is present within the range of 4 to 14 atomic percent with the balance being iron.

As a specific example of the practice of the invention, rare-earth element containing permanent magnet alloys of the compositions listed in Tables I and II were melted and used to produce permanent magnets for testing. The magnets were tested for magnetic alignment (anisotropy); the results are set forth in Table I:

TABLE I

| Alloy | | $H_A$ |
|---|---|---|
| Molecular Formula | Atomic Percent | (kOe) |
| *$DiFe_7B_{0.33}$ | Di = 12 Fe = 84 B = 4 | 37 |
| *$DiFe_{6.66}B_{0.33}$ | Di = 12.5 Fe = 83.4 B = 4.1 | 38 |
| $DiFe_{5.26}B_{0.4}$ | Di = 15.9 Fe = 83.5 B = 6.0 | 52 |
| $MMFe_7B_{0.33}$ | MM = 12 Fe = 84 B = 4 | 38 |
| $MMFe_{6.66}B_{0.33}$ | MM = 12.5 Fe = 83.3 B = 4.2 | 30 |
| $Nd_{\frac{3}{4}}Th_{\frac{1}{4}}Fe_{5.3}B_{0.33}$ | Nd = 10 Th = 5 Fe = 80 B = 5 | 43 |
| $YFe_{5.26}B_{0.4}$ | Y = 15 Fe = 79 B = 6 | 21 |

*Di is naturally occurring mixture of Pr and Nd (~80% Nd 20% Pr)

Magnetic alignment is expressed as the value $H_A$. An $H_A$ alignment value of 25 or better is required for satisfactory performance.

The alloys reported in the Table were produced in molten form and introduced as a free falling stream into a copper mold. This resulted in the formation of solidified alloy. The alloy was then crushed to 5 to 10 micron particle size. The fine powder was then oriented in a magnetic field and cold isostatically compacted to form a compacted cylinder. The compacted cylinder was then sintered at a temperature between 1000°-1100° C. and cooled to room temperature.

As may be seen from Table I the ternary alloy wherein yttrium is alloyed with iron and boron demonstrates an $H_A$ alignment value of 21, which is unsatisfactory for conventional magnet applications. In contrast, the remaining alloys wherein either didymium, mischmetal and a combination of neodymium and thorium are alloyed with boron and iron all of the $H_A$ alignment values are well above the required 25 min.

As may be seen from Table II the magnets in accordance with the compositions of the invention likewise exhibited good magnetic properties particularly magnetic induction, e.g. $BH_{max}$.

TABLE II

| Alloy | Atomic % | | | | | $B_r$ | $H_c$ | $H_{ci}$ | $BH_{max}$ |
|---|---|---|---|---|---|---|---|---|---|
| No. | Nd | Th | Fe | B | Di | (G) | (Oe) | (Oe) | (MGOe) |
| 20 | | | 79 | 6 | 15 | 12,300 | 2,800 | 2,850 | 21.4 |
| | 12 | 6 | 76 | 6 | | 11,600 | 2,850 | 3,150 | 16.1 |

What is claimed is:

1. A permanent magnet alloy consisting essentially of, in atomic percent, mischmetal 12 to 20, boron 4 to 14 and balance iron.

* * * * *